US006387864B1

(12) United States Patent
Bartelme

(10) Patent No.: US 6,387,864 B1
(45) Date of Patent: May 14, 2002

(54) COMPOSITION AND METHOD FOR PREVENTION OF DISCOLORATION OF DETERGENTS USING NONIONIC SURFACTANTS AND AN ALKALINE SOURCE

(75) Inventor: Michael James Bartelme, Eden Prairie, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/738,536

(22) Filed: Dec. 15, 2000

(51) Int. Cl.[7] ..... C11D 1/66; C11D 3/08; C11D 3/10; C11D 3/30

(52) U.S. Cl. ..... 510/336; 510/337; 510/339; 510/340; 510/356; 510/361; 510/499; 510/506

(58) Field of Search ..... 510/336, 337, 510/339, 340, 356, 361, 499, 506

(56) References Cited

U.S. PATENT DOCUMENTS

| | | | | |
|---|---|---|---|---|
| 3,422,021 | A | 1/1969 | Roy | 252/161 |
| 3,664,961 | A | 5/1972 | Norris | 252/99 |
| 4,412,933 | A | 11/1983 | Klahr et al. | 252/174.19 |
| 4,661,279 | A | 4/1987 | Parker | 252/94 |
| 4,753,755 | A | 6/1988 | Gansser | 252/527 |
| 5,080,819 | A | 1/1992 | Morganson et al. | 252/90 |
| 5,340,501 | A | 8/1994 | Steindorf | 252/546 |
| 5,670,473 | A | 9/1997 | Scepanski | 510/445 |
| 5,723,428 | A | 3/1998 | Boskamp et al. | 510/481 |
| 5,876,514 | A | 3/1999 | Rolando et al. | 134/25.2 |
| 5,929,283 | A | 7/1999 | Uno et al. | 564/506 |
| 6,080,711 | A | 6/2000 | Brouwer et al. | 510/324 |

*Primary Examiner*—Gregory Delcotto
(74) *Attorney, Agent, or Firm*—Vidas, Arrett & Steinkraus

(57) ABSTRACT

A laundry detergent composition comprising about 1 to about 75 parts by weight of at least one caustic compound, about 0.5 to about 50 parts by weight of at least one nonionic surfactant, about 1 to about 35 parts by weight of at least one primary amine compound having the following general formula:

$$NH_2—CH_2—(CHR)_n—OH$$

where each R is independently hydrogen, $C_1$ to $C_{30}$ alkyl, aryl, etheral, amino, hydroxy, alkoxy, or ester and n is 0 to 12, and about 1 to about 60 parts by weight of at least one builder, filler, or mixture thereof.

17 Claims, No Drawings

COMPOSITION AND METHOD FOR PREVENTION OF DISCOLORATION OF DETERGENTS USING NONIONIC SURFACTANTS AND AN ALKALINE SOURCE

FIELD OF THE INVENTION

The present invention relates to a detergent composition having improved oxidative and color stability, and to a method of making and using the same. The detergent composition comprises at least one nonionic surfactant in combination with an alkaline compound, and at least one primary amine compound.

BACKGROUND OF THE INVENTION

Alkaline sources, also referred to as caustic compounds, are used in detergent compositions for a variety of reasons, one of which is to provide detersive action and improved soil removal performance. Typical sources of alkalinity include alkali metal hydroxides such as potassium hydroxide and sodium hydroxide, alkaline earth metal silicates including potassium silicate and sodium silicate, and so forth.

One problem that occurs with the use of high amounts of an alkaline source in combination with a nonionic surfactant is oxidative deterioration and subsequent discoloration of the detergent, particularly in the presence of high temperatures, oxygen and/or water.

The present invention provides a detergent composition having excellent color stability over extended periods of time which involves adding a primary amine compound to the detergent compositions.

SUMMARY OF THE INVENTION

The present invention relates to a laundry detergent composition comprising about 1 to about 75 parts by weight of at least one caustic compound, about 0.5 to about 50 parts by weight of at least one surfactant, about 1 to about 35 parts by weight of at least one primary amine compound, and about 1 to about 60 parts by weight of at least one builder, filler, or mixture thereof. The primary amine compound is represented by the following general formula:

$$NH_2—CH_2—(CHR)_n—OH$$

where each R is independently hydrogen, $C_1$ to $C_{30}$ alkyl, aryl, etheral, amino, hydroxy, alkoxy, or ester, and n is 0 to 12.

The present invention further relates to a method of preparing the detergent composition of the present invention by mixing the in ingredients at an elevated temperature. The detergent composition comprises about 1 to about 75 parts by weight of at least one caustic compound, about 0.5 to about 50 parts by weight of at least one surfactant, about 1 to about 60 parts by weight of at least one builder, filler, or mixture thereof, about 10 to about 20 parts by weight water, and about 0.01 to about 35 parts by weight of at least one primary compound having the following general formula:

$$NH_2—CH_2—(CHR)_n—OH$$

where each R is independently hydrogen, $C_1$ to $C_{30}$ alkyl, aryl, etheral, amino, hydroxyl, alkoxy, or ester, and n is 0 to 12. The composition may be optionally dried.

The present invention further relates to a method of improving the stability of a laundry detergent comprising a detersive caustic compound and a nonionic surfactant, the method comprising adding about 0.05% to about 2% by weight of the detergent of a primary amine compound represented by the following general formula:

$$NH_2—CH_2—(CHR)_n—OH$$

where each R is independently hydrogen, $C_1$ to $C_{30}$ alkyl, aryl, etheral, amino, hydroxyl, alkoxy, or ester, and n is 0 to 12.

All US patents and applications and all other documents mentioned anywhere in this application are incorporated herein by reference in their entirety.

DETAILED DESCRIPTIONS OF THE PREFERRED EMBODIMENTS

The present invention provides a detergent formulation having improved oxidative stability and color retention. The formulation has at least one nonionic surfactant, at least one caustic compound or source of alkalinity, and at least one primary amine compound.

Surprisingly, the incorporation of the primary amine compound reduces the color degradation of the detergent compositions.

Surfactant

The detergent formulations of the present invention comprise at least one nonionic surfactant. Nonionic surfactants useful herein include, but are not limited to, alkoxylated, e.g. ethoxylated, alcohols and alkyl phenols; alkoxylated fatty alcohols of $C_6$ to $C_{22}$ including ethoxylated and mixed ethoxylated-propyloxylated fatty alcohols; polyoxyalkylene and alkyl polyoxyalkylene surfactants; alkylene oxide block copolymers such as ethylene oxide/propylene oxide block copolymers; polyhydroxy fatty acid amides; alkyl polyglycosides; alkylpolysaccharides; glycerol ethers; long chain amine oxides including dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis(2-hydroxyethyl)-3-dodecoxy-2-hydroxypropylamine oxide, (2-hydroxypropyl)methyltetradecylamine oxide, dimethyloleylamine oxide, dimethyl-(2-hydroxydodecyl)amine oxide, and the corresponding decyl, hexadecyl and octadecyl homologs; long chain phosphine oxides; dialkyl sulfoxides; fatty esters of glycerol; alkoxylated, e.g. ethoxylated, glyceryl esters; condensation products of ethylene oxide with the reaction products of propylene oxide and ethylenediamine; sorbitans and alkoxylated, e.g. ethoxylated, sorbitans; alkoxylated, e.g. ethoxylated phosphate esters; and so forth.

Particularly useful nonionic surfactants include the condensation products of primary and secondary aliphatic alcohols having about 1 to about 25 moles of ethylene oxide. The alkyl chain of the aliphatic alcohol can be either straight or branched, primary or secondary, and generally contains from about 8 to about 22 carbon atoms. The surfactants typically have about 1 to about 20 moles of ethylene oxide (EO), and preferably 3 to 15 moles of EO, and even more preferably about 5 to about 12 moles of EO per mole of alcohol. Condensates with propylene oxides (PO) and butylene oxides (BO) may also be used.

Examples of commercially available nonionic surfactants of this type include, for example the TERGITOL® line of nonionic surfactants including 15-S-9 ($C_{11}$–$C_{15}$ linear alcohol; 9 moles EO) available from Union Carbide Corp. in; the NEODOL® line of nonionic surfactants including 45-9

($C_{14}$–$C_{15}$ linear alcohol; 9 moles EO) available from Shell Chemical Co. in Houston, Tex.; and $C_{13}$–$C_{15}$ oxo-alcohol ethoxylates available from BASF under the tradename of LUTENSOL® AO.

The nonionic surfactants are useful from about 0.5 to about 50 parts by weight of the detergent formulation, and preferably from about 5 to about 30 parts by weight of the formulation. Nonionic surfactants are discussed in U.S. Pat. No. 3,422,021 incorporated herein by reference in its entirety, and in McCutchins, *Detergents and Emulsifiers*, 1973 Annual and in *Surface Active Agents*, Vol. 2, by Schwartz, Perry and Burch, Interscience Publishers, 1958 and in *Kirk-Othmer Concise Encyclopedia of Chemical Technology*, 1985 at pp. 1143–1144, each of which is incorporated by reference herein.

Other co-surfactants may be used in combination with the nonionic surfactants including anionic, cationic, and zwitterionic or amphoteric surfactants.

Useful zwitterionic or amphoteric surfactants include the betaines and sulfobetaines, i.e. sultaines. Examples of betaines include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanoate and tetradecyldipropyl ammonium pentanoate, and so forth.

Amphoteric surfactants may be broadly described as derivatives of aliphatic, or alkyl substituted hetero cyclic, secondary and tertiary amines in which the aliphatic radical may be straight chain or branched and wherein one of the aliphatic substituents contains from about 8 to 18 carbon atoms and at least one contains an anionic water-solubilizing group, e.g., carboxy, sulfonate and sulfate, and include, but are not limited to, N-coco-3-aminopropionic acid and acid salts, N-tallow-3-iminodiproprionate salts; N-lauryl-3-iminodiproprionate disodium salt; N-carboxymethyl-N-cocoalkyl-N-dimethylammonium hydroxide; N-carboxymethyl-N-dimethyl-N-(9-octadecenyl) ammonium hydroxide; (1-carboxyheptadecyl) trimethylammonium hydroxide; (1-carboxyundecyl) trimethylammonium hydroxide, N-cocoamidoethyl-N-hydroxyethylglycine sodium salt; N-hydroxyethyl-N-stearamidoglycine sodium salt; N-hydroxyethyl-N-lauramido-β-alanine sodium salt; N-cocoamido-N-hydroxyethyl-β-alanine sodium salt; mixed alcyclic amines, and their ethoxylated and sulfated sodium salts; 2-alkyl-1-carboxymethyl-1-hydroxyethyl-2-imidazolinium hydroxide sodium salt or free acid wherein the alkyl group may be nonyl, undecyl, or heptadecyl; 1,1-bis(carboxymethyl)-2-undecyl-2-imidazolinium hydroxide disodium salt and oleic acid-ethylenediamine condensate; propoxylated and sulfated sodium salt; amine oxide amphoteric surfactants; sodium 3-(dodecylamino)propionate, sodium 2-(dodecylamino)ethyl sulfate; sodium 2-(dimethylamino) octadecanoate; disodium 3-(N-carboxymethyldodecylamino)propane-1-sulfonate; disodium octadecyl-iminodiacetate; sodium 1-carboxymethyl-2-undecylimidazole; sodium N,N-bis(2-hydroxyethyl)-2-sulfato-3-dodecoxy-propylamine; and so forth. This list is intended for illustrative purposes only, and is by no means an exclusive list.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent attached to an "onium" atom and containing an anionic water-solubilizing group, e.g., carboxy, sulfonate, sulfate, phosphate, or phosphonate. Examples of zwitterionic surfactants include 3-(N, N-dimethyl-N-hexadecylammonio)-propane-1-sulfonate; 3-(N,N-dimethyl-N-hexadecylammonio)-2-hydroxypropane-1-sulfonate; N,N-dimethyl-N-dodecylammonio acetate; 3-(N,N-dimethyl-N-dodecylammonio)propionate; 2-(N,N-dimethyl-N-octadecylammonio)ethyl sulfate; 3-(P,P-dimethyl-P-dodecylphosphonio)propane-1-sulfonate; 2-(S-methyl-S-tert-hexadecylsulfo)ethane-1 -sulfonate; 3-(S-methyl-S-dodecylsulfonio)propionate; N,N-bis(oleylamidopropyl-N-methyl-N-carboxymethylammonium betaine; N,N-bis (stearamidopropyl)-N-methyl-N-carboxymethylammonium betaine; N-(stearamidopropyl)-N-dimethyl-N-carboxymethylammonium betaine; 3-(N-4-n-dodecylbenzyl-N,N-dimethylammonio)propane-1-sulfonate; 3-(N-dodecylphenyl-N,N-dimethylammonio)-propane-1-sulfonate; and so forth.

Amphoteric or zwitterionic surfactants are discussed in commonly assigned U.S. Pat. No. 5,876,514 incorporated by reference herein.

Useful anionic surfactants include, but are not limited to, alkyl benzene sulfonates; primary, branched-chain and random alkyl sulfates; secondary (2,3) alkyl sulfates; unsaturated sulfates such as oleyl sulfate; alpha-sulfonated fatty acid esters; sulfated alkyl polyglycosides; alkyl alkoxy sulfates such as EO 1–7 ethoxy sulfates; alkyl alkoxy carboxylates including EO 1–5 ethoxycarboxylates; amine oxides; alkyl ether sulfates which are the condensation products of ethylene oxide and monohydric alcohols having about 10 to about 20 carbon atoms derived from natural fats, e.g., coconut oil or tallow, or from synthetic means including sodium coconut alkyl triethylene glycol ether sulfate, lithium tallow alkyl triethylene glycol ether sulfate, sodium tallow alkyl hexaoxyethylene sulfate, and so forth; paraffin sulfonates and olefin sulfonates in which the alkyl or alkenyl group contains from about 10 to about 20 carbon atoms; $C_8$–$C_{22}$ soaps; disulfonates, disulfates; and so forth.

Alkali metal fatty acid soaps of a mono- or di-carboxylic acid including those of oleic, ricinoleic acid, alk(en)yl succinate such as dodecyl succinate, and fatty acids derived from castor oil, rapeseed oil, groundnut oil, coconut oil, palmkernel oil or mixtures thereof may also be utilized as cosurfactants. Sodium or potassium are commonly used counterions. These fatty acid soaps typically have anywhere from about 8 to about 24 carbon atoms and preferably about 10 to about 20 carbon atoms.

Any combination of surfactants may be utilized provided that the surfactant mixture have at least one nonionic surfactant. The cosurfactants are useful from about 0.5 to 50 parts by weight. This list is intended only as a guide, and not as an exclusive list. Surfactants are discussed in detail in *McCutcheon's Detergents and Emulsifiers*, 1999, North American Edition, MC Publishing Co.

Source of Alkalinity

The compositions of the present invention are alkaline based and have at least one source of alkalinity. These alkaline compounds provide excellent detersive action to the detergent compositions. Alkali metal hydroxides, carbonates and bicarbonates are suitably employed in the present invention as sources of alkalinity. While any of the alkali metals may be suitably employed, sodium and potassium are desirable. Sodium hydroxide and sodium carbonate, i.e. soda ash, are utilized in some particular embodiments of the present invention.

Typically, an alkalinity source raises the pH of the composition to at least about 10.0 in a 1 wt % aqueous solution, and generally to a range of from about 10.0 to 14. This higher pH increases the efficacy of the soil removal and sediment breakdown when the chemical is placed in use and further facilitates the rapid dispersion of soils. The general character of the alkalinity source is limited only to those chemical compositions which have a greater solubility.

The caustic compounds are useful from about 1 to about 75 parts by weight of the detergent formulation, and preferably from about 20 to about 60 parts by weight of the formulation.

Amine Compound

The detergent formulations of the present invention comprise at least one primary amine compound having the following general formula:

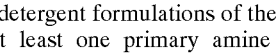

$$NH_2—CH_2—(CHR)_{n—OH} \quad (I)$$

where each R is independently hydrogen, $C_1$ to $C_{30}$ alkyl, aryl, etheral, amino, hydroxy, alkoxy, or ester and x is 0 to 12.

The amine compound has at least one hydroxyl group which is separated from the nitrogen by 1 to 12 carbon atoms.

A group of primary amines represented by this structure include linear amines having the following general structure:

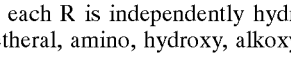

$$NH_2(CH_2)_xOH \quad (II)$$

where x is 1 to 30. Included in this structure are monoethanolamine (III) where x is 2,3-amino-1-propanol (IV) where x is 3, and 5-amino-1-pentanol (V) where x is 5. These amines are represented by the following chemical formulas:

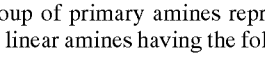

$$NH_2—CH_2—CH_2—OH \quad (III)$$

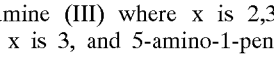

$$NH_2—CH_2—CH_2—CH_2—OH \quad (IV)$$

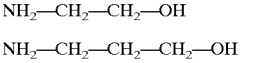

$$NH_2—CH_2—CH_2—CH_2—CH_2—CH_2—OH \quad (V)$$

Another example of a useful primary amine compound is serinol (VI) which is represented by the following chemical formula:

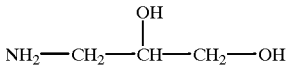

(VI)

Another example of a useful primary amine compound is monoisopropanolamine (VII) which is represented by the following chemical formula:

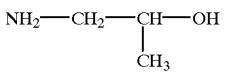

(VII)

The primary amine compounds represented above are associated with one another by the fact that the nitrogen is in a position where it is sterically unhindered by other chemical groups.

The primary amine compound is useful from about 1 to about 60 parts by weight of the composition, and preferably from about 0.1 to about 35 parts by weight of the composition. For some embodiments of the present invention, the primary amine can be advantageously used in very small amounts of about 0.01 to about 5 parts by weight, and preferably from about 0.05 to about 2 parts by weight.

Builders or Fillers

Detergency builders or fillers may be suitably employed in the present invention. Detergency builders or fillers are used to treat or soften water and to prevent the formation of precipitates or other salts. A builder is typically a material that enhances or maintains the cleaning efficiency of a detergent composition. Several types of compounds with different performance capabilities are used.

Builders have a number of functions. For instance, they can supply alkalinity to a detergent formulation useful for cleaning acid soils, and can provide buffering to maintain alkalinity at an effective level to aid in keeping removed soil from redepositing during washing into emulsified oil and greasy soils. However, their primary function is the inactivation of water hardness by complexing with hard water cations which form salts insoluble in water, for example calcium and magnesium cations, through the mechanism of sequestration or cation exchange. Detergency builders include the broad classes of phosphorus-containing inorganic salts, organic builders and non-phosphorous-containing builders.

Commonly used detergency builders include, but are not limited to, Examples of useful organic builders include, for example, the alkali metal salts of ethylenediaminetetraacetic acid (EDTA), nitrilotriacetates, oxydisuccinates, melitic acid salts, benzene polycarboxylates, tartrate mono succinate, tartrate di succinate, citrates, polyacetates, carboxylates, polycarboxylates, polyacetyl carboxylates, polyhydroxysulfonates, carbonates, bicarbonates, and so forth. Sodium, potassium, lithium, ammonium, and substituted ammonium salts are commonly employed.

Examples of phosphorous-containing inorganic detergency builders include the water-soluble salts, orthophosphates, polyphosphates including the alkali metal pyrophosphates such as tetrasodium or tetrapotassium pyrophosphates and tripolyphosphates such as sodium and potassium tripolyphosphates, alkali metal metaphosphates, phosphonates, phosphates and hexametaphophates, and so forth.

Phosphorous-free detergency builders include, but are not limited to, alkali metal silicates including cation-exchange amorphous or crystalline aluminosilicates (i.e. zeolites) of natural or synthetic origin.

As noted above, the builders may operate through sequestration of ion complexation mechanisms.

Some specific preferred builders include, but are not limited to, EDTA, diethylenetraminepentaacetic acid, hydroxyethylethylenediaminetetraacetic acid, aminotri (methylenephosphonic acid), 2-phosphonobutane-1,2,4-tricarboxylic acid, diethylenetriaminepenta (methylenephosphonic acid), and so forth.

Sequestrants or chelating agents are include those molecules capable of coordinating the metal ions commonly found in water and preventing the metal ions from interfering with the functioning of detersive components within the composition. Examples of those that operate through the mechanism of sequestration include, for example, complex phosphates, phosphonates, amino carboxylic acids, water soluble acrylic polymers, among others.

Examples of phosphonate compositions include phosphonic acids and phosphonic acid salts including the mono, di, tri and tetraphosphonic acids which can also contain groups capable of forming anions under alkaline conditions such as carboxy, hydroxy, thio and the like.

Some examples of amino carboxylic acids include, but are not limited to, N-hydroxyethyliminodiacetic acid, nitrilotriacetic acid (NTA), ethylenediaminetetraacetic acid (EDTA), N-hydroxyethyl-ethylenediaminetriacetic acid (HEDTA), and dimethylenetriaminepentaacetic acid (DTPA).

Examples of water soluble acrylic polymers include, but are not limited to, polyacrylic acid, polymethacrylic acid, acrylic acid-methacrylic acid copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, and so forth, and mixtures thereof. The water soluble salts or partial salts of these polymers including the alkali metal salts of sodium or potassium, and ammonium salts are also suitably employed. In certain embodiments of the present invention, polyacrylic acid polymers, the partial sodium salts of polyacrylic acid or sodium polyacrylate having average molecular weights within the range of 4000 to 8000 are utilized.

An example of a useful ion exchange builder are the silicates such as sodium aluminum silicate.

Other useful fillers include kaolin clays; smectite clays including alkali and alkaline earth metal montmorillonites, saponites and hectorites; bentonite clays; starches; and so forth. Some of these materials also provide fabric softening characteristics such as the smectite clays and the bentonite clays.

Detergent builders are well understood materials and are known to those of skill in the art. Builders are discussed in commonly assigned U.S. Pat. No. 5,876,514 incorporated by reference herein in its entirety.

Optional Ingredients

Other optional components include, but are not limited to, fabric softeners, optical brighteners such as fluorescent whitening agents, enzymes and their stabilizers, perfumes, colorants, antifoaming agents, e.g. silicone compounds, preservatives, and so forth. Such additives are known to those of skill in the art.

The detergent compositions may be supplied in various forms including solid, i.e. granular, gel, aerosol, and liquid. They may be provided in an aqueous medium, and as a concentrate or dilute solution.

They may be used in any type of detergent formulation including for laundry, dishwashing detergents, especially automatic dishwashing detergents, warewashing, hard surface cleaning, clean-in-place (CIP), clean-out-of-place, and so forth.

The compositions of the present invention are processed as a molten melt at elevated temperatures of greater than about 57° C. (135° F.), typically about 71–79.4° C. (160–175° F.). At these temperatures, the compositions can degrade causing a discoloration from a white or bright yellow to brown, particularly when large scale commercial batches are produced. The larger batches tend to require longer periods of time for a satisfactory mix, such as several hours or more. The addition of the primary amine compounds prevents this discoloration from occurring. The resultant compositions exhibit improved oxidative stability and color retention at high manufacturing temperatures, as well as over the course of the shelf life of the composition.

EXAMPLES

Examples 1–3

Formulations were prepared as indicated in Tables 1–3 using total batch sizes of about 20–30 grams. The formulations were mixed at 100° with air bubbled through the mixture at a rate of approximately 100 cc/min. The air accelerates the rate of discoloration for periods of 30–45 minutes and then observed for color. Results are reported in Tables 1–3.

TABLE 1

| Ingredient | Example 2 | Comparative Example A |
|---|---|---|
| sodium hydroxide beads | 15 wt-% | 15.5 wt-% |
| sodium hydroxide solution (50%) | 23 wt-% | 23 wt-% |
| LUTENSOL ® AO-7 | 40 wt-% | 41.5 wt-% |
| water | 19 wt-% | 20 wt-% |
| isopropanol | 1.1 wt-% | — |
| monoethanolamine (MEA) | 1.2 wt-% | — |
| sodium metabisulfite | 0.6 wt-% | — |
| Color after 30–45 minutes | white | amber |

TABLE 2

| Ingredient | Example 3 | Comparative Ex B | Comparative Ex C |
|---|---|---|---|
| sodium hydroxide beads | 19.5 wt-% | 21 wt-% | 19.5 wt-% |
| sodium hydroxide solution (50%) | 25 wt-% | 23 wt-% | 25 wt-% |
| LUTENSOL ® AO-7 | 42.5 wt-% | 45 wt-% | 43 wt-% |
| water | 10.5 wt-% | 11 wt-% | 11 wt-% |
| isopropanol | 1 wt-% | — | 1.5 wt-% |
| monoethanolamine | 1.5 wt-% | — | — |
| sodium sulfate | — | — | — |
| color after 30–45 min | white | dark brown | dark brown |

TABLE 3

| Ingredient | Example 4 | Comparative Example D |
|---|---|---|
| sodium hydroxide beads | 18 wt-% | 18 wt-% |
| sodium hydroxide solution (50%) | 24.5 wt-% | 25 wt-% |
| LUTENSOL ® AO-7 | 42 wt-% | 43 wt-% |
| water | 14 wt-% | 14 wt-% |
| isopropanol | — | — |
| monoethanolamine | 1.5 wt-% | — |
| sodium sulfate | | — |
| color after 30–45 minutes | white | amber |

Example 4: A commercial batch size formulation (total batch size 340.65 kg, 751 pounds) was prepared as indicated in table 4, mixing for 5 hours at about 71–77° C. (160–170° F.).

TABLE 4

| Ingredient | Function | weight-% |
|---|---|---|
| soft water | | 2.7 |
| sodium hydroxide solution (50%) | alkaline source | 13 |
| aminotrimethylenephosphonic acid soln. (ATPM) solution (50%) | builder | 4.0 |
| polyacrylic acid solution (50%) | builder | 2.0 |
| monoethanolamine (99% active) | primary amine compound | 0.27 |
| LUTENSOL ® AO-7 | nonionic surfactant | 11.1 |
| LUTENSOL ® AO-11 | nonionic surfactant | 11.1 |
| sodium hydroxide beads | alkaline source | 34.9 |

TABLE 4-continued

| Ingredient | Function | weight-% |
|---|---|---|
| SAG 30 silicone mixture | antifoaming emulsion | 0.13 |
| BLANKOPHOR ® DML | fluorescent whitening agent | 0.27 |
| sodium coco/vegetable tallowate 20/80 | surfactant | 2.0 |
| polyacrylic acid salt | builder | 18.5 |
| fragrance oils | fragrance | 0.13 |

BLANKOPHOR ® DML is available from Bayer.

The resultant product of this example exhibited a final viscosity of 6000 mPa's at 65° C. (6000 cPs at 149° F.) and exhibited good color retention after mixing was complete.

The disclosure is intended to be illustrative and not exhaustive. This description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A laundry detergent composition, comprising:

a) about 1 to about 75 parts by weight of at least one caustic compound;

b) about 0.5 to about 50 parts by weight of at least one nonionic surfactant;

c) about 1 to about 35 parts by weight of at least one primary amine compound having the following general formula:

$$NH_2—CH_2—(CHR)_n—OH$$

where each R is independently hydrogen, $C_1$ to $C_{30}$ alkyl, aryl, etheral, amino, hydroxy, alkoxy, or ester and n is 0 to 12; and d) about 1 to about 60 parts by weight of at least one builder, filler, or mixture thereof wherein said at least one builder and said at least one filler are different from said at least one caustic compound.

2. The composition of claim 1 comprising:

a) about 20 to about 60 parts by weight of said at least one caustic compound;

b) about 5 to about 30 parts by weight of said at least one nonionic surfactant;

c) about 0.05 to about 2 parts by weight of said at least one primary amine compound; and d) about 10 to about 25 parts by weight of said at least one builder, filler, or mixture thereof.

3. The composition of claim 1 wherein said primary amine is represented by the following general formula:

$$NH_2(CH_2)_nOH$$

wherein n is 1 to 12.

4. The composition of claim 3 wherein n is 1, 3 or 5.

5. The composition of claim 1 wherein said primary amine is monoisopropanolamine.

6. The composition of claim 1 wherein said primary amine is serinol.

7. The composition of claim 1 wherein said composition comprises at least one builder or filler selected from sodium chloride, sulfates, cellulosics, diatomaceous earth, amorphous silica, or mixtures thereof.

8. The composition of claim 1 wherein said builder is selected from polyacrylates, phosphonates, phosphates, polycarboxylates, aminocarboxylates, gluconates, zeolites, clays, or mixtures thereof.

9. The composition of claim 1 wherein said caustic compound is selected from alkali metal hydroxides, alkali metal carbonates, alkali metal phosphates, silicates, or mixtures thereof.

10. The composition of claim 1 wherein said caustic compound is potassium hydroxide, sodium hydroxide, sodium carbonate, or a mixture thereof.

11. The composition of claim 1 wherein said at least one nonionic surfactant is selected from linear or branched alcohol alkoxylates, alkyl phenol alkoxylates, polyalkylene oxides, or mixtures thereof.

12. The composition of claim 10 wherein said at least one nonionic surfactant is a linear alcohol ethoxylate.

13. The composition of claim 1 further comprising at least one surfactant which is selected from anionic, cationic, zwitterionic, amphoteric, or polyglycoside surfactants.

14. The composition of claim 1 further comprising a compound selected from the group consisting of dyes, fragrances, defoamers, optical brighteners, and mixtures thereof.

15. The composition of claim 1 providing improved color stability of greater than 2 weeks at a temperature of about 50° C.

16. The composition of claim 1 providing improved oxidative stability of greater than 2 weeks at a temperature of about 50° C.

17. The composition of claim 1 wherein said laundry detergent is in a solid, liquid, gel or aerosol form.

* * * * *